United States Patent [19]

Bolanos et al.

[11] Patent Number: 4,955,843

[45] Date of Patent: Sep. 11, 1990

[54] BOAT TOY AND METHOD FOR MAKING SAME

[75] Inventors: Henry Bolanos, Mountain Lake; John Piszko, Edison, both of N.J.; David M. Williams, New York, N.Y.

[73] Assignee: Gruner + Jahr Printing and Publishing Co., New York, N.Y.

[21] Appl. No.: 800,883

[22] Filed: Nov. 22, 1985

Related U.S. Application Data

[63] Continuation of Ser. No. 583,565, Feb. 27, 1984, abandoned.

[51] Int. Cl.[5] ..... A63H 23/02

[52] U.S. Cl. ..... 446/160

[58] Field of Search ..... 446/160, 163, 164, 165, 446/93, 94, 95

[56] References Cited

U.S. PATENT DOCUMENTS

| | | | |
|---|---|---|---|
| 4,144,669 | 3/1979 | Ogawa | 446/153 X |
| 4,349,985 | 9/1982 | Kodaka | 446/163 |

*Primary Examiner*—Mickey Yu

*Attorney, Agent, or Firm*—Toren, McGeady & Associates

[57] ABSTRACT

A floatable toy having a raft portion with longitudinally extending edges and two pontoons in the form of floatable, generally cylindrically shaped bodies. Each pontoon has a longitudinal axis and is affixed to the raft adjacent a longitudinal edge thereof so that the longitudinal axis of the pontoon is parallel to the longitudinal edge of the raft. Arcuate brackets extend from each of the longitudinal edges of the raft for affixing the pontoons to the raft. At least a portion of the brackets are adapted to cooperate with and interfit into depressions in the cylindrical walls of the pontoons to provide a positive means for securing the pontoons to the raft.

2 Claims, 3 Drawing Sheets

BOAT TOY AND METHOD FOR MAKING SAME

This is a continuation of application Ser. No. 583,565, filed Feb. 27, 1984, now abandoned.

BACKGROUND OF THE INVENTION

This invention relates to a floatable toy and in particular a toy having the general configuration of a boat comprising a raft portion and being floatable by virtue of pontoons affixed to the raft.

Pontoon-supported boats for carrying passengers and cargo are, of course, well known and their design and methods of manufacture are directed to the specific problems encountered in fabricating such full size vessels. Examples of such designs are found in the patent art in U.S. Design Pat. No. D-123,501; U.S. Pat. No. 3,426,716; U.S. Pat. No. 3,063,398; U.S. Pat. No. 2,394,764; and U.S. Pat. No. 2,077,526.

It is also known to produce toy boats comprising pontoons, such prior knowledge being exemplified by U.S. Pat. No. 4,045,907.

The different problems associated with the design and manufacture of full size vessels as compared to toy boats are well illustrated by the above referred to prior art. In the case of full size vessels, such considerations as safety, strength, hydrodynamics and the like are paramount. Accordingly, the means for fastening the pontoon to the remainder of the vessel are all designed with these factors in mind. Thus, in U.S. Pat. No. 3,063,398 a T-shaped lug adapted to interfit with and anchor a clamp carried by the body of the vessel is provided. In U.S. Pat. No. 2,394,764 a complex arrangement of saddle and flange means interconnected with tie rods and trim buckles is provided. In U.S. Pat. No. 3,426,716 a split tube welded to a plate engages arcuate flanges depending from the body of the vessel to secure the pontoon to the vessel.

In contrast with the aforementioned designs, waterworthiness and strength are not the principle criteria in designing a toy boat. In many cases, the features which provide such attributes are actually detrimental in a toy in that they represent sharp edges and breakable elements which can be dangerous to a small, active child. Beyond question, they do not lend themselves to high speed manufacturing processes which are essential for the practical mass marketing of children's toys.

Thus, for example, in U.S. Pat. No. 4,045,907 for a toy boat, the simple solution suggested is to merely secure the pontoons to the body of the boat by gluing. The apparent simplicity of this design notwithstanding, several drawbacks are associated therewith. In the manufacturing process, the glue must be carefully registered and placed at the proper location and only at the proper location. Deposition of excess glue must be avoided. The drying process must be completed prior to further manufacture and packaging. All these steps greatly slow the manufacturing process. Additionally, the choice of glue for a toy boat to be used in a bathtub environment by a small child is extremely limited. Such choice is constrained when it is considered that the toy will be employed in hot soapy water which will tend to attack the glue seal. Needless to say, the issue of toxicity will also eliminate many otherwise useful glues.

Accordingly, there is a need for an improvement in a toy boat of this kind which is easy to assemble and avoids complex or dangerous elements.

SUMMARY OF THE INVENTION

In accordance with this invention, a floatable toy is provided which obviates the problems associated with the affixation of pontoons to a raft-like portion of the toy and specifically, avoids the problems of complex connecting means, gluing or requiring difficult assembly steps.

The floatable toy of this invention comprises a raft portion having longitudinally extending edges and two pontoons which comprise floatable, generally cylindrically shaped bodies, each having a longitudinal axis and each affixed to the raft adjacent to a longitudinal edge with the longitudinal axis of the pontoons parallel to said longitudinal edge. Means are provided for affixing the pontoons in such position to the raft, these means comprising arcuate brackets extending from each of the longitudinal edges. At least a portion of said brackets are adapted to cooperate with and interfit into depressions in the cylindrical wall of the pontoons to present a positive means for securing said pontoons to the raft portion.

Preferably, a plurality of brackets are provided extending from each of the longitudinal edges of the raft with at least one of said brackets extending from the bottom portion of the raft and at least another of said brackets extending from the top portion of the raft to support the pontoon. It will be understood that as used herein the term "top", with respect to the raft, refers to the surface of the raft facing out of the water and the term "bottom", with respect to the raft, refers to the surface of the raft facing into the water. In a first embodiment, the brackets are each provided with a rib portion extending radially from the inner circumferential surface toward the center of curvature of said brackets, the ribs being adapted to interfit into the depressions in the cylindrical walls of the pontoons. In another embodiment, the entire bracket interfits into the depressions in the cylindrical walls of the pontoons to present a smooth cylindrical surface comprising said bracket and said cylindrical walls of the pontoons.

In another aspect of this invention, the brackets are molded integrally with the body of the raft and, owing to the selection of materials of construction and the thickness of the brackets, have a slight degree of flexibility. Accordingly, the raft portion and the pontoons may be molded separately. To assemble the floatable toy, each pontoon may be axially aligned along one longitudinal edge and in front of said raft portion in a position whereby the pontoon is rotated out of its intended position of rotation when finally assembled. The pontoon may then be slid into position, parallel to and adjacent to the longitudinal edge of the raft and past the brackets which, owing to their flexible nature yield about the cylindrical walls of the pontoon. Because the pontoon has been rotated out of its intended position, the depressions in the cylindrical walls do not catch the brackets as the pontoon is slid into position. Once in its proper axial position, the pontoon may be rotated to align the depressions with the brackets which, again owing to their flexibility, will seat in the depressions to complete the assembly.

DETAILED DESCRIPTION OF THE INVENTION

Figure 1:
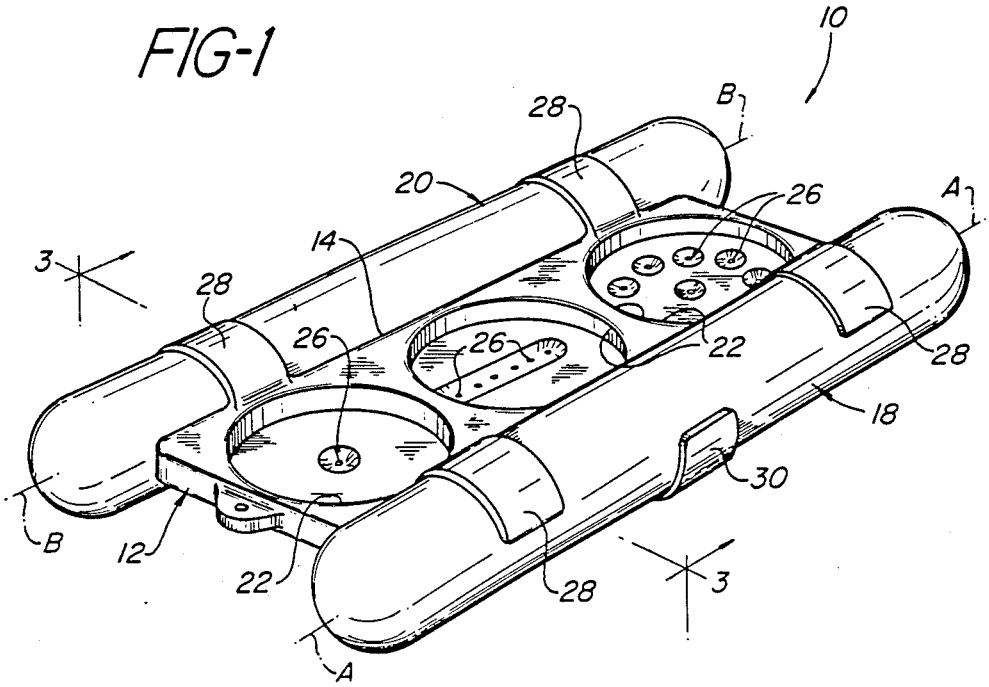
FIG. 1 is a perspective, assembled view of a floatable toy embodying the teachings of this invention.
Figure 3:
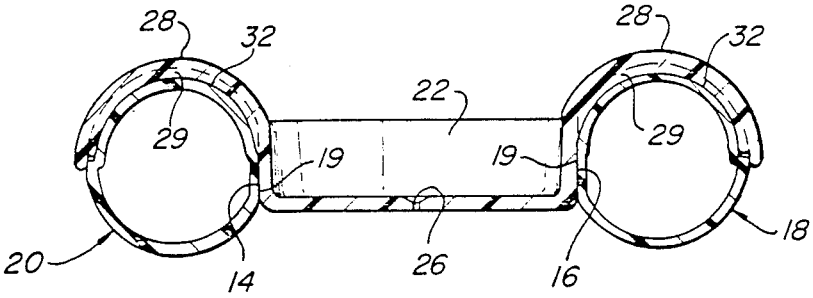
FIG. 3 is a transverse, cross-sectional view of the floatable toy of FIG. 1, taken through line 3—3.
Figure 2:
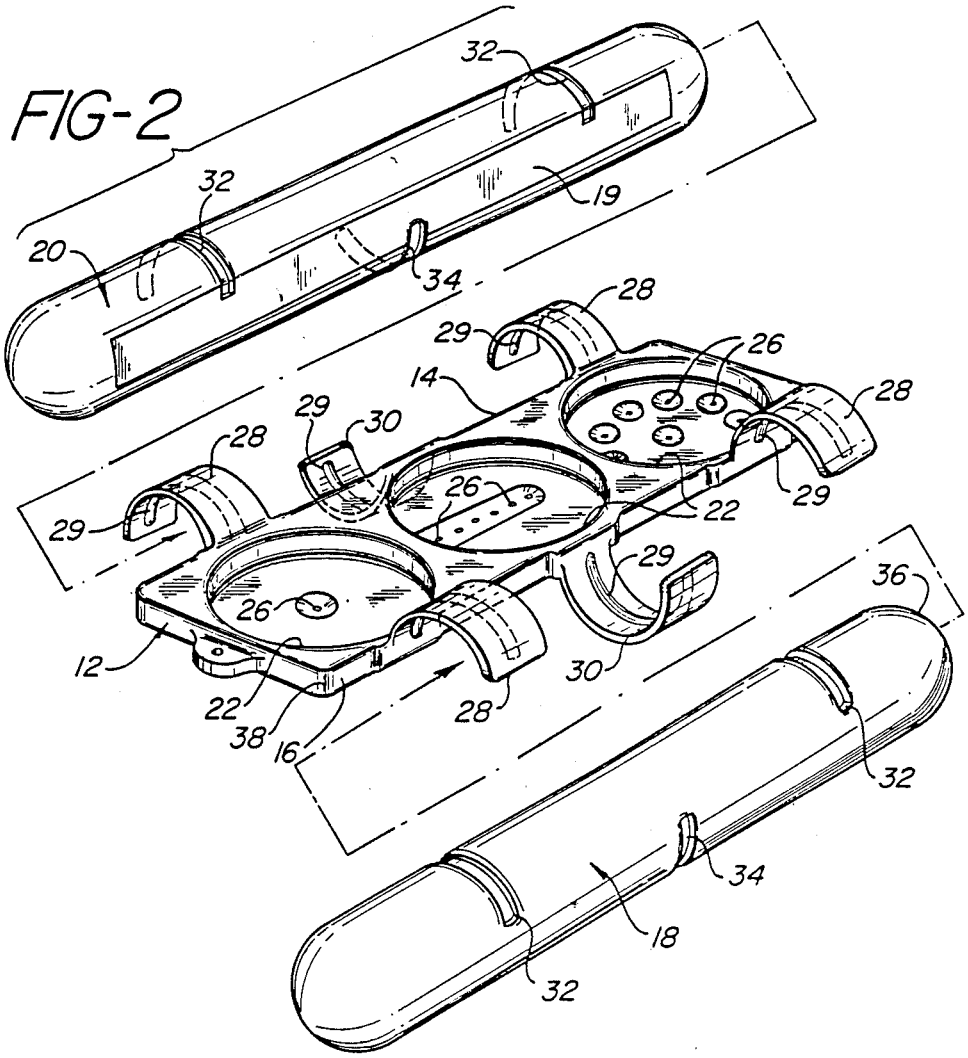
FIG. 2 is a perspective, exploded view of the floatable toy of FIG. 1.

Referring now to the drawings, FIGS. 1-3 depict, in perspective assembled, perspective exploded and transverse cross-sectional views, respectively, a floatable toy 10 embodying the teachings of this invention.

The floatable toy 10 comprises a raft portion 12 having longitudinally extending edges 14 and 16. The raft portion 12 of toy 10 may include various additional structure to enhance the play value of the toy including, for example, a cabin like structure, a mast, a wheel house or the like. As depicted in the drawings, the raft is provided with a plurality of apertures or depressions 22. The floor of the depressions 22 are provided with drain holes 26. Various additional play-enhancing elements (not shown) may be provided with the toy and adapted to fit within the appertures or depression such as, for example, trays, cups, sprinkling cans or the like.

The toy 10 is provided with two pontoons 18 and 20, which are floatable and generally cylindrically shaped bodies each having a longitudinal axis A—A and B—B, respectively. In the assembled position as depicted in FIGS. 1 and 3, the pontoons are affixed to the raft, each adjacent to a longitudinal edge, with the longitudinal axis of the pontoons parallel to said longitudinal edge. As best seen in FIG. 3, a portion 19 of the cylindrical surface of the pontoons is flattened to better fit against the longitudinal edge of the raft.

In accordance with the teachings of the invention, the means for affixing the pontoons to the raft comprise brackets extending from the longitudinal edges of the raft, at least a portion of the brackets adapted for cooperating and interfitting with depressions in the cylindrical walls of the pontoons. As shown in FIGS. 1-3, upper brackets 28 are provided, integral with and extending from the top of the longitudinal edges of the raft. Lower brackets 30 are provided extending from the bottom of the longitudinal edges of the raft. Brackets 28 and 30 are arcuate to conform and fit closely to the cylindrical walls of the pontoons. The brackets are provided with rib portions 29 which extend circumferentially along the inner surface of the brackets and depend toward the center of curvature of the brackets. The term "inner surface" of the brackets will be understood to mean that surface facing toward the surface of the pontoons when the floatable toy is assembled.

The rib portions 29 of the brackets are adapted to interfit into depressions 32 and 34 provided in top and bottom portions of the pontoons. By so interfitting, the pontoons are held securely to the raft portions.

In accordance with a further aspect of this invention, the design described herein lends itself to a simple, commercially practical means for assembly. Firstly, the brackets are selected to be constructed of a material and to have a thickness such as to impart to the brackets a degree of flexibility. In this connection, such flexibility shall mean that the brackets may be moved away from their intended position when the toy is in its assembled condition and may be biased to return to its intended position when the moving force is withdrawn.

To assemble the toy, each pontoon 18 and 20 is axially aligned along one longitudinal edge, e.g., edge 16 and in front of the raft portion, e.g., the end portion 36 of pontoon 18 is adjacent the raft corner 38. The pontoon at this point in the process should be in a position of rotation about its axis away from its intended position of rotation when the toy is fully assembled. Preferably the pontoon is rotated 10° to 180° out of its intended position and more preferably 45° to 135°. The pontoon is then slid into a position parallel to and adjacent to the longitudinal edge of the raft and past the brackets and rib portions which, owing to their flexibility, yield about the cylindrical walls of the pontoon. Because the pontoon has been rotated, the depressions in the cylindrical walls do not interfere and catch the rib portions of the brackets as the pontoon is slid into position. Once in the proper axial position, the pontoon may be rotated to align the depressions with the rib portions of the brackets which, again owing to their flexibility, will seat into the depressions and present the assembled pontoon.

Figure 4:
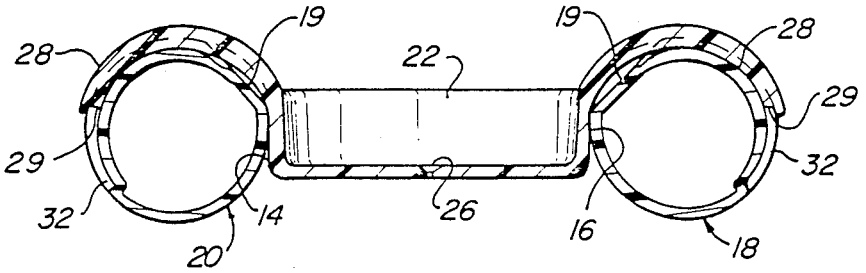
FIG. 4 is a transverse, cross-sectional view of the floatable toy of FIG. 1, taken through line 3—3 at a point in time intermediate to the process for assembling the toy.

FIG. 4 depicts the partially assembled toy, in a transverse cross-sectional view similar to that of FIG. 3, at a point in the assembly wherein pontoons 18 and 20 have been aligned with longitudinal edges 16 and 14, respectively, and the brackets 28 and 30 are out of alignment with depressions 32 and 34 (not shown). As shall be understood from the above discussion, by now rotating the pontoons about their longitudinal axes, the depressions may be brought into alignment with the bracket and the brackets will seat therein, reducing the toy to the assembled position shown in FIGS. 1 and 3.

Figure 5:
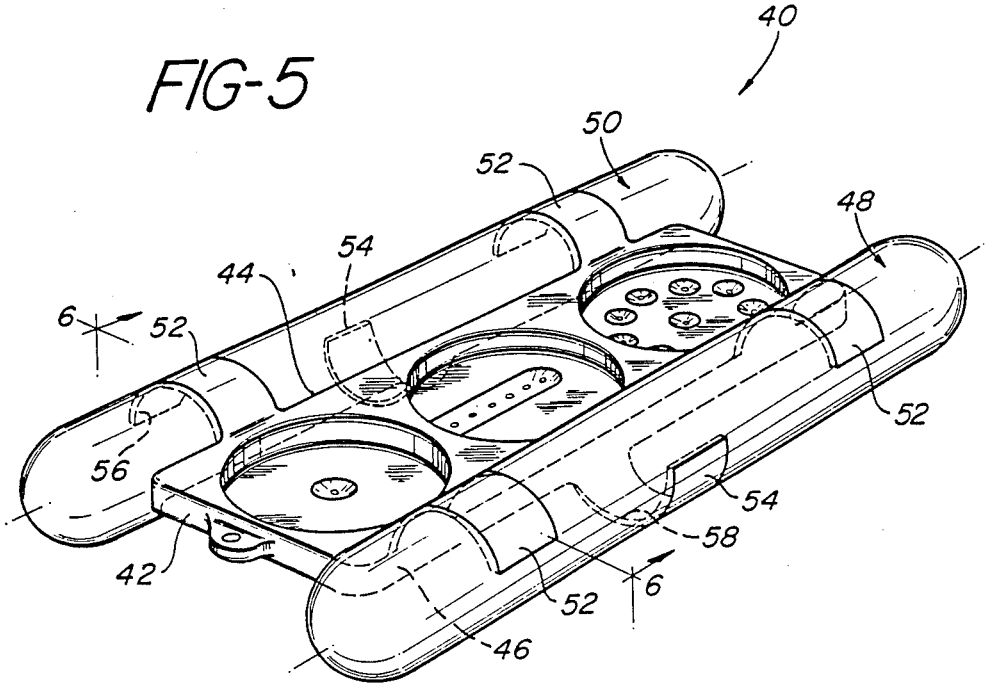
FIG. 5 is a perspective view of an alternative embodiment for the floating toy of this invention.
Figure 6:
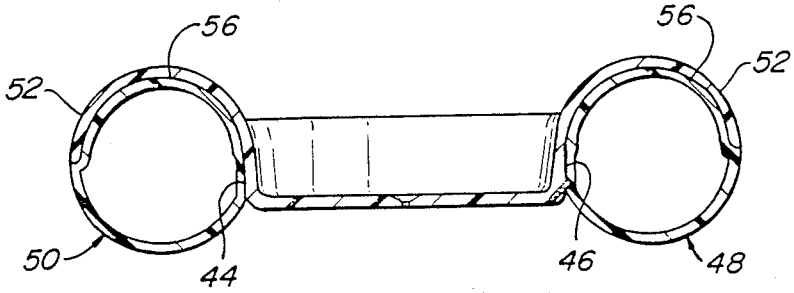
FIG. 6 is a transverse, cross-sectional view of the floatable toy of FIG. 5 taken through line 6—6.

Referring now to FIGS. 5 and 6, illustrated therein are perspective and transverse cross-sectional views of an alternate embodiment for the floatable toy of this invention.

The floatable toy 40 again comprises a raft portion 42 having longitudinally extending edges 44 and 46. The toy is provided with two pontoons 48 and 50 having the same general shape as those described in connection with FIG. 1. Brackets 52 and 54 are provided extending from longitudinal edges 44 and 46 of the raft portion 42, but unlike those of FIG. 1, the brackets of this embodiment are not provided with depending ribs. Instead the inner surface of brackets 52 and 54 are smooth. The pontoons 48 and 50 are provided with depressions 56 and 58 adapted to have the entire brackets 52 and 54 interfit therein. The depth and shape of the depression are provided such that when the brackets are interfitted and the floatable toy is in its assembled position, the brackets and the cylindrical walls of the pontoons will present a smooth cylindrical surface.

It will be understood that while the embodiments shown in the drawings illustrate two top brackets and one lower bracket, many other combinations are possible and will still meet the design critera prescribed herein. Thus, for example, one top bracket and two bottom brackets will be effective. Similarly, the brackets may be of uneven size and, in some instances, the top bracket may simply be elongated and only one will suffice. In the preferred embodiments, a plurality of brackets are employed with at least one of such being a top bracket and at least another being a bottom bracket. Needless to say, whatever the configuration of the brackets, the depression in the walls of the pontoons may be varied to conform thereto.

A wide choice of materials are suitable for use as the materials of construction for the toy including, for example, metals, water proof paper or boards, or even, in part, wood. Preferably however, the materials of choice are polymers which exhibit thermoplastic behavior, e.g., "plastics" such as polyolefins, e.g., polypropylene or polyethylene. Preferably the raft portion and its extending brackets are molded together using injection molding techniques. The pontoons are preferably molded by utilizing blow molding techniques, particularly when the raft portion is floatable by virtue of the pontoons being hollow.

What is claimed is:

1. A method of assembling a floatable toy comprising a raft portion having longitudinally extending edges and two pontoons comprising floatable, generally cylindrically shaped bodies, each of said pontoons having a longitudinal axis and being defined in part by a cylindrical wall having a depression therein and each to be affixed to the raft portion adjacent to and parallel with a longitudinal edge comprising:

providing flexible arcuate brackets extending from each of said longitudinal edges, at least a portion of said brackets being adapted to cooperating with and interfit into said depressions in the cylindrical walls of the pontoons;

axially aligning each pontoon along one longitudinal edge and in front of said raft portion in a position of rotation out of its intended position when finally assembled;

sliding said pontoon into axial position parallel to and adjacent the longitudinal edge of the raft and past the brackets; and rotating said pontoon to align the depression with the bracket to seat the brackets into said depressions.

2. A method according to claim 1 wherein said arcuate brackets are provided by integrally molding the same with said raft portion.

* * * * *